US005535583A

United States Patent [19]

Holzer et al.

[11] Patent Number: 5,535,583

[45] Date of Patent: Jul. 16, 1996

[54] METHOD OF FACETING A HOLLOW ROPE CHAIN

[75] Inventors: Stephen Holzer, Ruwa, Zimbabwe; Benjamin Hillel, Talpiot, Israel

[73] Assignee: Aurez Limited, Harare, Zimbabwe

[21] Appl. No.: 320,610

[22] Filed: Oct. 11, 1994

[51] Int. Cl.[6] ..... B21L 15/00

[52] U.S. Cl. ..... 59/35.1; 59/80

[58] Field of Search ..... 59/80, 82, 35.1, 59/3

[56] References Cited

U.S. PATENT DOCUMENTS

| | | | |
|---|---|---|---|
| D. 321,148 | 10/1991 | Chiaramonti et al. | D11/12 |
| D. 326,065 | 5/1992 | Borgogni | D11/13 |
| D. 340,422 | 10/1993 | Grando | D11/93 |
| D. 343,136 | 1/1994 | Grando | D11/12 |
| 4,651,517 | 3/1987 | Benhamou et al. | 59/80 |
| 5,125,225 | 6/1992 | Strobel | 59/80 |
| 5,129,220 | 7/1992 | Strobel | 59/80 |
| 5,285,625 | 2/1994 | Ofrat et al. | 59/80 |
| 5,408,820 | 4/1995 | Strobel et al. | 59/80 |
| 5,471,830 | 12/1995 | Gonzales | 59/80 |

FOREIGN PATENT DOCUMENTS

| | | |
|---|---|---|
| 014648 | 9/1989 | Germany . |
| 016267 | 3/1990 | Germany . |

*Primary Examiner*—David Jones
*Attorney, Agent, or Firm*—Helfgott & Karas

[57] ABSTRACT

A rope chain is fabricated of hollow links that have been intertwined to form a rope chain of the double helix type. The hollow rope chain is moved continuously, in a continuous length, over pulley guides whereon the exposed surface of the rope chain is deformed without material removal. Rotating tools, having sloped surfaces, wedge against the outer surface of the rope chain links and flatten them as the tool and chain move in opposite directions relative to each other. The tools have no cutting edges, but deform the rope chain entirely by wedging action of the tool surfaces that interfere with the outer circumference of the rope chain and move the link wall both inwardly and longitudinally. Conventional diamond cutting facet machines, which are used to shear facets, are adapted for use in accordance with the invention by removing the shearing tools and installing wedging tools.

9 Claims, 7 Drawing Sheets

METHOD OF FACETING A HOLLOW ROPE CHAIN

BACKGROUND OF THE INVENTION

This invention relates generally to rope chain jewelry and more particularly to rope chain jewelry of the diamond cut faceted type.

A rope chain may be made up of annular links formed of solid wire, usually a precious metal such as gold. The wire is formed into a C-shape, or each link may be a continuous loop by soldering the ends of the wire together after bending into a generally C-shape. In a known manner, a multiplicity of such individual links are intertwined to form, in outward appearance, a double helix rope chain. In order to reduce the weight of precious metal, and thereby reduce the cost of a finished item without any compromise in aesthetic appearance, rope chains have been made using hollow links. After formation, the individual hollow links are intertwined, just as the solid links are intertwined, to form what is known as a hollow rope chain.

Different appearances have been achieved for the solid link rope chains by using links of different cross sections and also by providing facets on the external surfaces of the rope chain. The facets are produced in a process known in the trade as "diamond cutting" by shearing away external portions of link surfaces, and many attractive patterns are the result. By faceting a solid link rope chain on four sides, a square shaped rope chain has been produced. Also, faceting has been done on six sides and eight sides to provide hexagonal and octagonal appearances. The faceting may be applied along the entire length of the rope chain or only in selected portions. Additionally, the flattened, sheared surfaces that comprise a facet, while generally running in a straight line lengthwise of the rope chain, have been made to run in a spiral around the rope, the spiral corresponding with the double helix construction of the chain itself.

Naturally, whenever a new faceted appearance is generated in a rope chain having solid links, there is an impetus to reproduce the same appearance in hollow link rope chains so that a lower cost version of the solid link faceted chain may be made available to the buying public without sacrifice in aesthetic appearance.

Because the metal in the hollow links is so thin, e.g., 0.0025 inches, it has not been possible to facet hollow link rope chains by the shearing technique that removes metal from the surface of the links. Such a machining approach to faceting can easily produce holes in the surface of the very thin metal, and destroy the appearance and worth of the rope chain.

Therefore, alternative techniques to provide the effect of faceting without shearing away material have been developed, and have proven to be successful in simulating the appearance of sheared facets. These techniques for faceting generally involve deformation of the hollow links by application of lateral forces to the surface of the hollow link and bending the link wall. Precise control over this bending and bending in small repeated increments produce flat surfaces that give the appearance of a sheared facet.

U.S. Pat. Nos. 5,125,225 and 5,129,220 issued respectively Jun. 30, 1992 and Jul. 14, 1992 to Kalman Strobel are illustrative of such a technique for producing hollow rope chains with an appearance of solid diamond cut rope chains. However, the procedures in the Strobel patents are complex and time consuming. Essentially, the method is a batch process wherein a length of rope chain is wrapped around a large drum and frozen in position. Then a tool moving transversely to the axis of the drum impacts against the chain and in a plurality of longitudinal passes, eight passes are mentioned, a flattening of the links is achieved. Then the drum upon which the rope chain is wrapped may be rotated, for example, 90° and the entire multi-stepped procedure is repeated until the desired number of flat portions are produced on the external surface of the rope chain.

Thus, a costly and time-consuming process is required to provide a hollow faceted rope chain. The freezing procedure can add an extra twenty minutes during manufacture. When the rope chain is unwound from the drum, the spacing between the flattened facets will depend upon the diameter of the drum and the number of times the drum is incrementally rotated during the entire process.

What is needed is a simpler method for faceting hollow rope chains that more realistically simulates the faceting results produced when shearing solid link chains.

SUMMARY OF THE INVENTION

It is an object of the present invention to provide an improved method for producing a faceted hollow rope chain for use in jewelry that provides a new aesthetic visual appearance.

Another object of the invention is to provide an improved method of faceting a hollow rope chain that uses conventional manufacturing equipment, as is used in shearing methods to facet solid rope chains.

Still a another object of the invention is to provide an improved method of faceting a hollow rope chain that allows for continuous processing of a hollow rope chain regardless of length.

A further object of the invention is to provide an improved method of faceting a hollow rope chain that produces a generally round, moderately deformed cross section to provide a squared, hexagonal or octagonal look.

In accordance with the invention, a rope chain is fabricated of hollow C-shaped links that have been intertwined, as is known in the art, to form a rope chain of the double helix type. The hollow rope chain is moved continuously, in a longitudinal direction along its continuous length over pulley guides whereon the exposed surface of the rope chain is deformed without material removal. Rotating tools, having sloped surfaces, with curved profiles wedge against the outer surface of the rope chain links and flatten them as the tools and chain move in opposite directions relative to each other.

The tools have no cutting edges, but deform the rope chain entirely by wedging action of the tool surfaces that interfere with the outer circumference of the rope chain and move the link wall both inwardly and longitudinally. Conventional diamond cutting facet machines, which are used to shear facets, are adapted for use in accordance with the invention by removing the shearing tools and installing wedging tools.

The invention accordingly comprises the several steps and the relation of one or more of such steps with respect to each of the others thereof, which will be exemplified in the method hereinafter disclosed, and the scope of the invention will be indicated in the claims.

BRIEF DESCRIPTION OF THE DRAWINGS

For a fuller understanding of the invention, reference is had to the following description taken in connection with the accompanying drawings in which.

DESCRIPTION OF PREFERRED EMBODIMENTS

Figure 1:
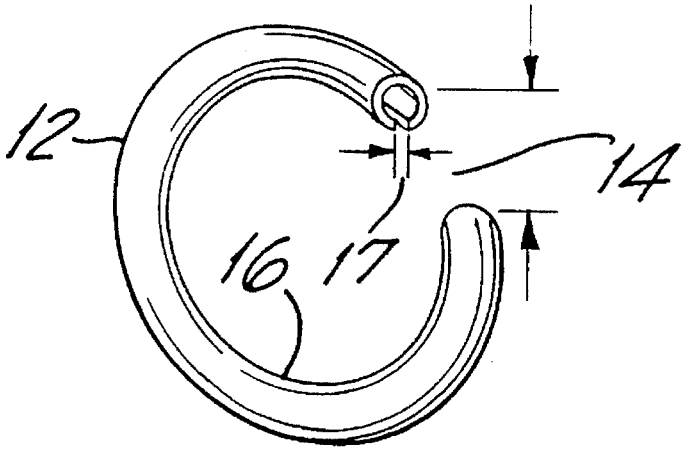
(PRIOR ART) FIG. 1
FIG. 1 is a perspective view to an enlarged scale of a hollow link of the prior art.
Figure 2:
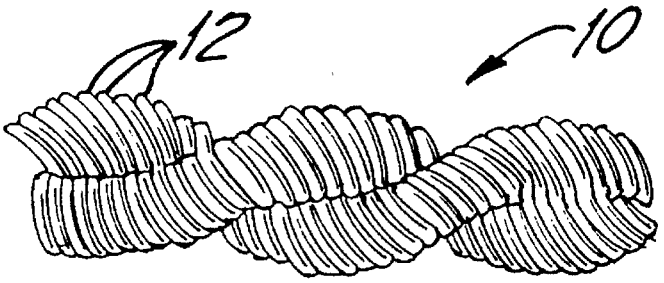
(PRIOR ART) FIG 2
FIG. 2 is a hollow rope chain formed of links as in FIG. 1.

FIG. 2 illustrates a segment of a double-helix rope chain 10 as is used in making necklaces, bracelets, and the like. Constructions of rope chains are well known in the jewelry arts. The rope chain 10 is made by intertwining many similar links 12. Each link, as illustrated in FIG. 1, is a hollow toroid with a gap 14 between the ends of the link and a longitudinal seam 16 running around the inside of the link. Thus, the link 12 is similar to an automobile tire except that a segment is missing from the circumference. A rope chain 10 made from such links 12 is known as a hollow link rope chain.

The links 12 are made by taking a flat sheet of thin precious metal, for example, 0.0025 inch thick gold, and wrapping it around a non-precious core wire, which may be aluminum or copper, leaving the seam 16 with a second gap 17, around the periphery. The elongated rod, thus formed, is then wrapped around a mandrel in a spiral-like fashion and is cut into sections to form the links with the small gap 14 and the seam 16. The links are typically flattened so that they lie in a plane. The core is removed by melting or by action of an acid or caustic soda as is appropriate to the non-precious metal used for the core. The completed links are then intertwined in the known manner to make the rope chain 10.

It should be understood that the order of steps described above may be varied, and the thin layer of precious metal may be applied to a solid non-precious core by other known techniques, for example, by drawing the core and thin sheet of precious metal through a round die, as described in U.S. Pat. No. 5,129,220, so that the sheet of precious metal forms an open tube with a non-precious metal core.

U.S. Pat. No. 4,651,517 to Benhamou gives details of techniques used in intertwining links, whether hollow or solid, to form a rope chain. These patents are incorporated herein by reference. Forming a rope chain from links is not a novel portion of the present invention and, accordingly, is not described in detail herein.

Such rope chains can be faceted, for example, as described in U.S. Pat. No. 5,129,220, mentioned above. However, applying facets to links individually, or after intertwining to form the rope chain, presents added difficulties where hollow links are employed. It is relatively simple to shear away the outer surface of solid links to provide facets, but similar procedures if applied to hollow links can cause holes in the wall of the link, whereby the attractiveness and salability of the jewelry is lost. Nevertheless, techniques have been developed in the prior art whereby hollow links in a rope chain can be given the appearance of sheared facets, and still enjoy an economy in using the hollow links.

Figure 3A:
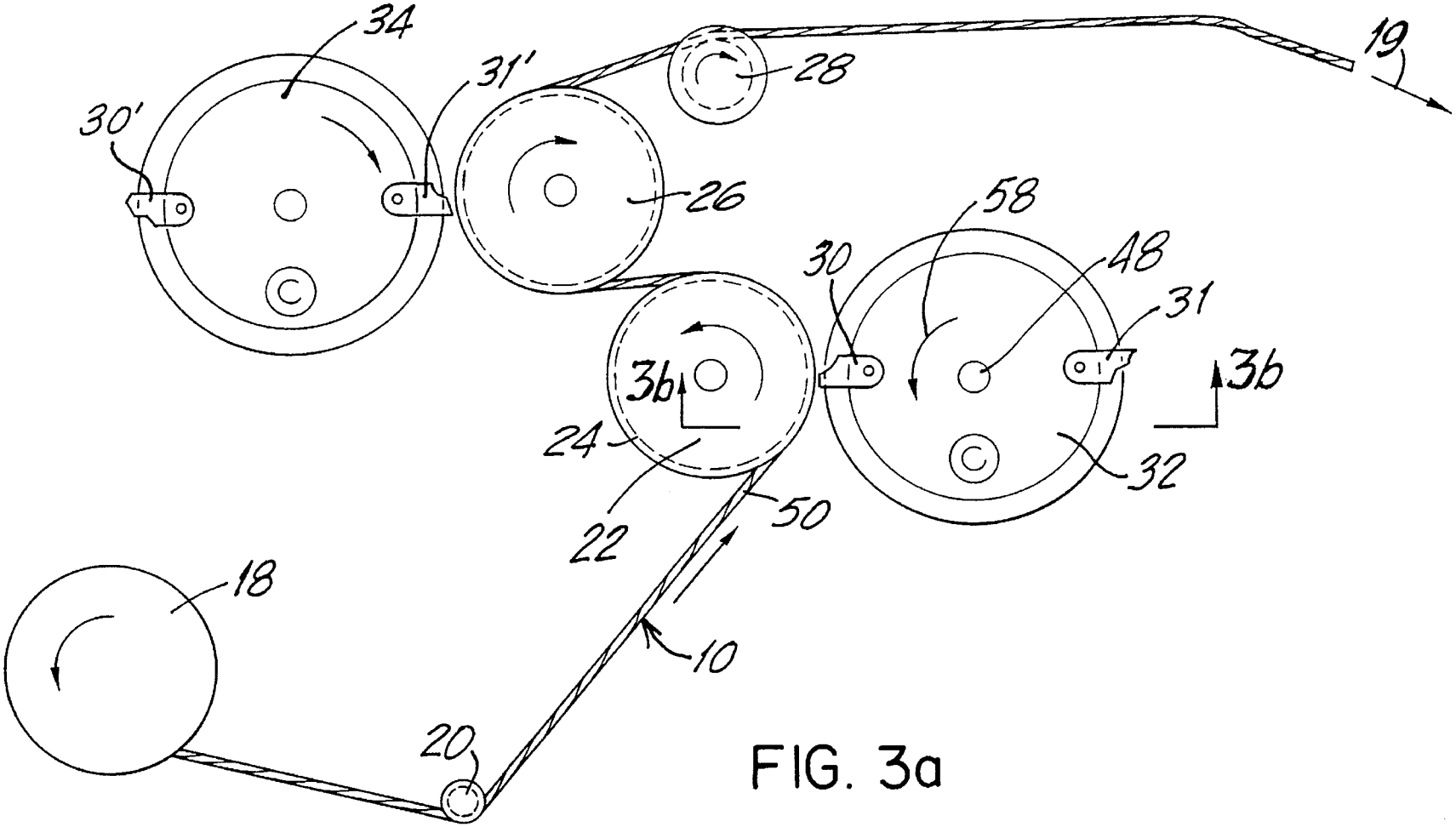
FIG. 3*a* is a schematic representation of an apparatus for performing the method in accordance with the invention.

FIG. 3*a* illustrates schematically an apparatus for manufacturing a faceted hollow rope chain in accordance with the invention. A hollow rope chain 10, produced conventionally without facets, of extended length is pulled from a spool 18 of chain 10 at a continuous rate indicated by the arrow 19 by a mechanism (not shown). The rope chain 10 passes over a tensioning idler 20 and around a first pulley wheel 22 where the chain 10 is recessed in a groove 24 of the pulley wheel 22, indicated by the broken line. The chain 10 leaves the pulley wheel 22 and moves around a similar pulley wheel 26 and then over an idler 28 before exiting the apparatus. Passing over two pulleys 22, 26, directly from one pulley to the other, maintains a requisite axial orientation of the rope chain. In an actual machine, the rope chain may be taken up on another spool for storage.

The spool 22 rotates counterclockwise (as illustrated) and the spool 26 rotates clockwise. The outer surface of the rope chain 10 that passes over the first pulley wheel 22 becomes the inner surface of the chain 10 as it passes around the second pulley wheel 26. Thus, one surface of the rope chain 10 is exposed and may be worked at the pulley wheel 22 and the opposite surface is exposed and may be worked at the pulley wheel 26.

Wedging tools 30, 31 are mounted on a tool holder 32 facing the pulley wheel 22 and each of the tools 30, 31 forms or works a respective quadrant (FIG. 6) on the outside surface of the rope chain 10 as the tools 30, 31, in turn, and the chain 10 move into positions of tangency. Similar tools 30', 31' on a tool holder 34 operate on the other two quadrants of the rope chain 10 at the pulley wheel 26, as described more fully hereinafter.

Figure 3B:
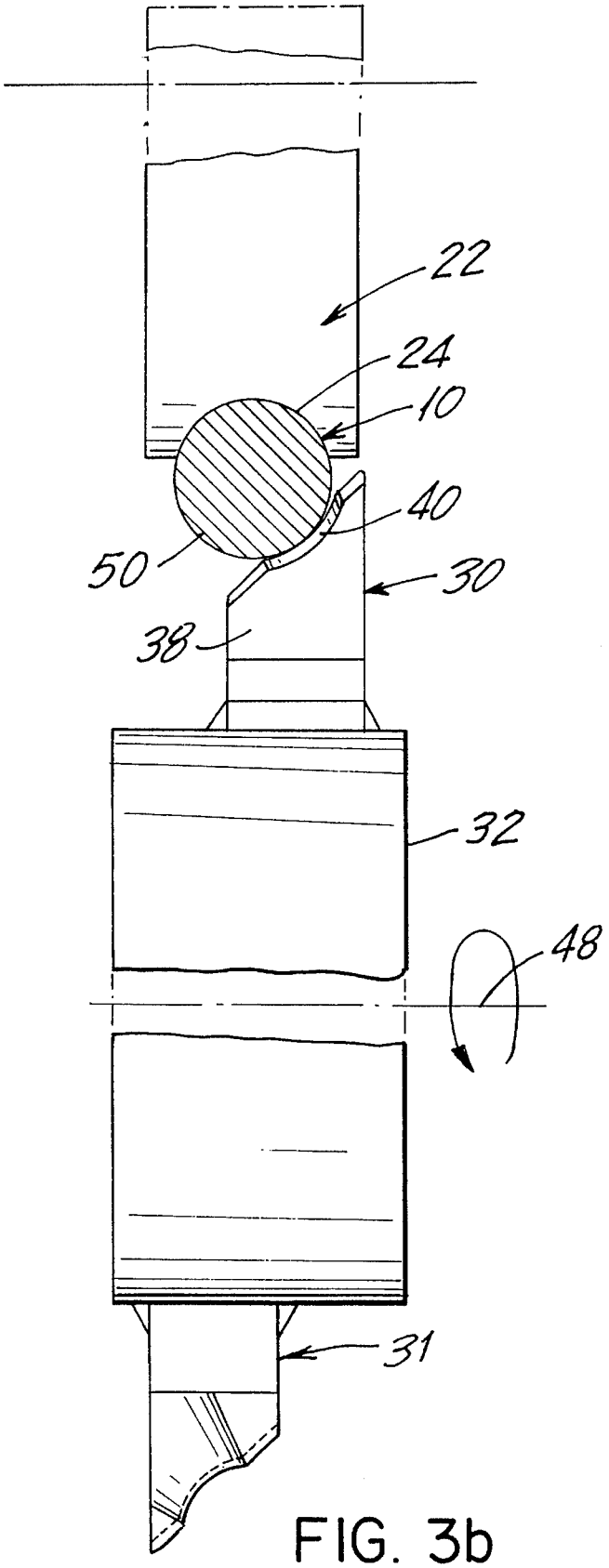
FIG. 3*b* is a view taken along the line 3*b*–3*b* of FIG. 3*a;*
Figure 4:
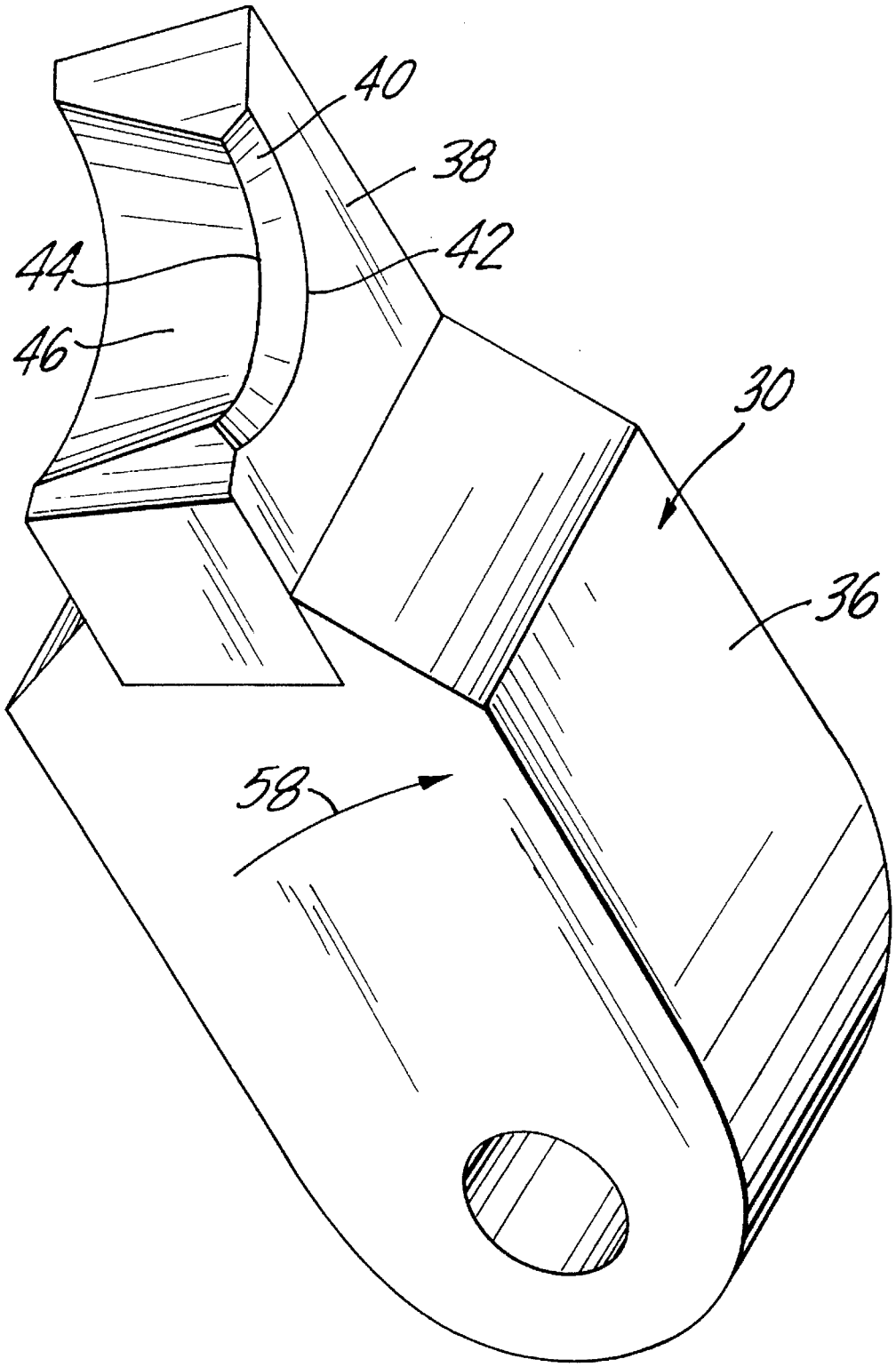
FIG. 4 is an enlarged perspective view of a wedging tool illustrated in a tool assembly of FIG. 3.

FIG. 4 illustrates a wedging tool 30. The tools 30, 30', 31 31' are of similar construction except that the pair of tools on each tool holder are mirror images of each other. Accordingly, the description of one faceting station is applicable to the other. The tool 30 includes a body 36 that is mounted fixedly into the associated tool holder 32, and a working end 38 is fixedly connected to the body 36 and extends beyond the outer circumference of the associated tool holder 32, 34 (FIG. 3). The working end 38 includes a bevelled or sloped wedge surface 40 that is defined between a leading arcuate edge 42 and a trailing arcuate edge 44. The wedge surface 40 is a generally conical segment. A second generally conical surface 46 intersects the wedge surface 40 along the trailing arcuate edge 44 to produce an arcuate crest that is the most distant edge in FIG. 7 of the surface 40 on the tool 30 from a center of rotation 48 of the associated tool holder 32.

The lesser distance between the center of rotation 48 and the leading arcuate edge 42 of the wedge surface 40 is such that the tool 30 passes through the point of tangency, (FIGS. 3*a, b*) with the rope chain 10 without any contact between the leading edge 42 and the chain 10. The distance between the center of rotation 48 and the crest at the edge 44 defines the maximum deformation which the tool 30 can cause on the outer surface 50 of the chain 10.

Figure 6:
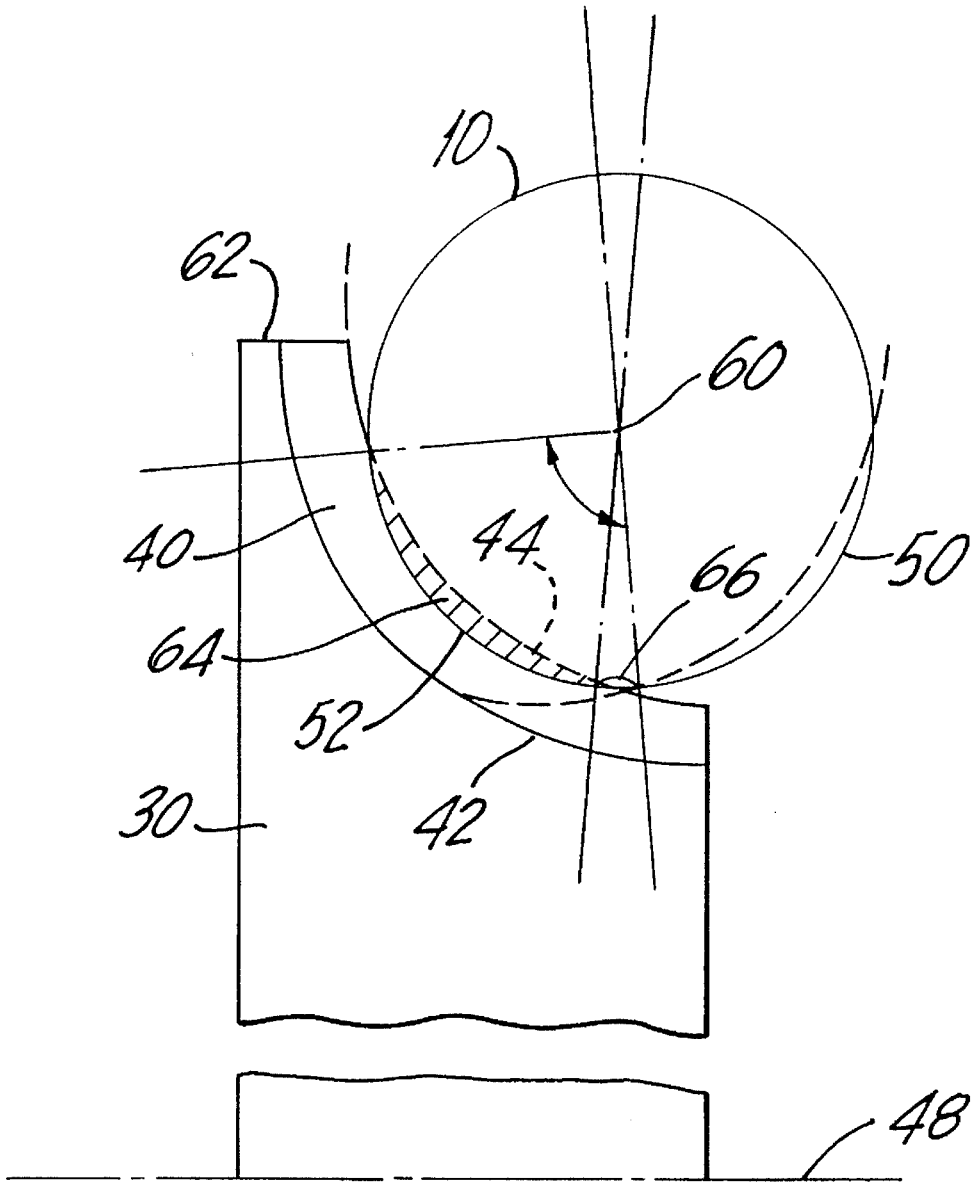
FIGS. 6 and 7 are end and side views, respectively, showing the interaction between the tool and the rope chain to produce faceting of a hollow rope chain.
Figure 7:
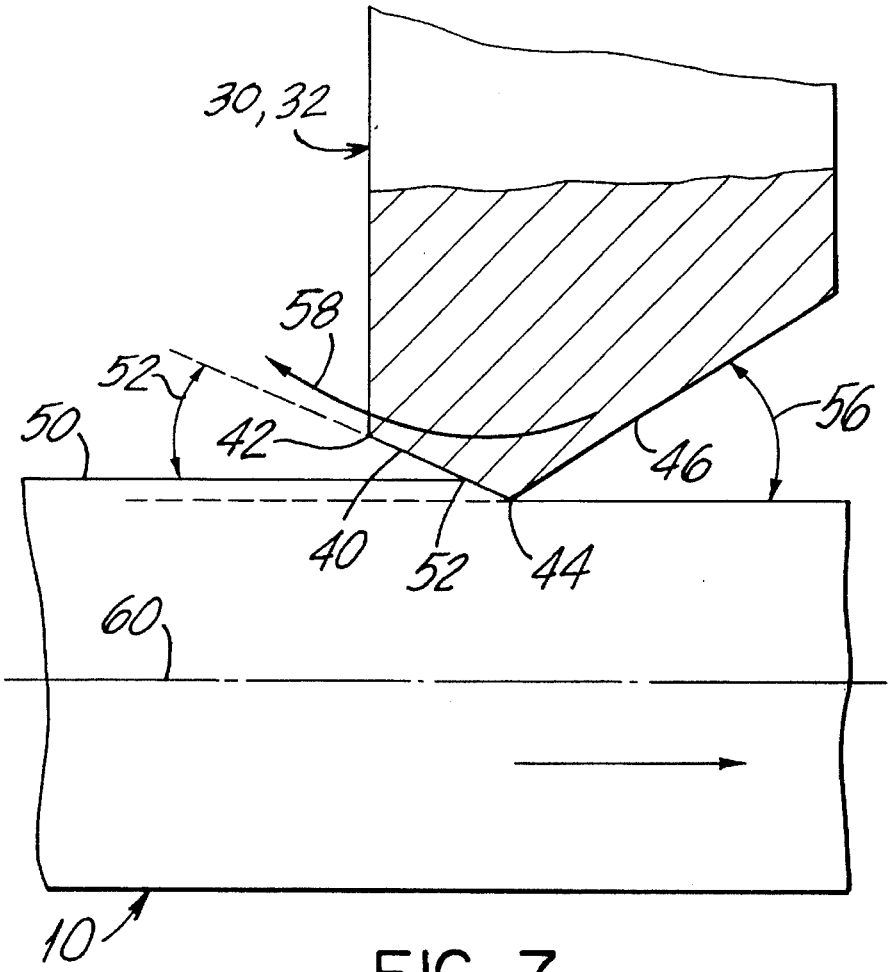

As best illustrated in FIGS. 6, 7 the arcuate lines of the leading edge 42 and the trailing edge 44 of the wedging surface 40 have greater radii than the radius of the undeformed rope chain 10. Contact between the wedge surface 40 and the outer surface 50 of the chain 10 occurs at a point 52 (FIG. 7) located between the leading edge 42 and trailing edge 44 of the surface 40. This point 52 has a location determined by the angle 54 that defines the relationship between the surface 40 of the tool 30 and the outer surface 50 of the chain 10 at the point of tangency where forming action occurs. The wedging angle 54 is selected within a range of values when attaching the tool 30 to its associated tool holder 32. The point of contact 52 illustrated in FIG. 7 becomes a line or region, as better illustrated in FIG. 6, as the wedge surface 40 deforms the outer surface 50 of the chain 10.

The radii of the edges 42, 44 may be selected in accordance with the desired final appearance of the chain to a point where the edges are nearly straight lines.

In operation, the tool holder 32 rotates in the direction indicated by the arrow 58 (FIG. 7).

Figure 8:
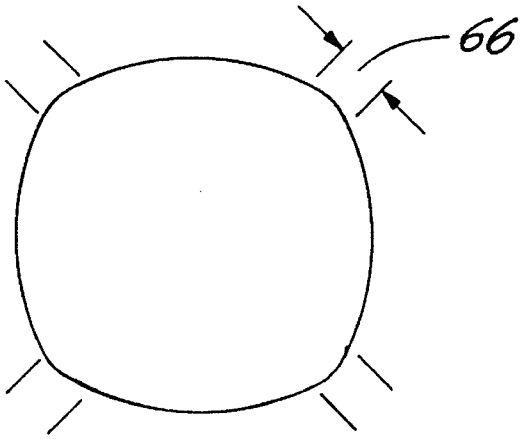
FIG. 8 is an end view of a rope chain having four facets produced in accordance with the method of the present invention.

Operation of the tool 30 on the chain 10 is illustrated in FIGS. 6, 7 and 8. In FIG. 6, a chain 10 is shown in an end view. Those skilled in the art will appreciate that a rope chain is in the form of a double helix so that the perfect circular cross-sectional area illustrated in FIG. 6 is a generalized representation of the envelope of a chain and no actual section through the rope chain links at a right angle to the longitudinal axis 60 is a true circle. Thus, the amount of faceting that is effected on adjacent links of the chain varies and some links receive no faceting at all.

With regard to FIG. 6, assuming that the center line 48 of tool rotation and the circular section of the chain envelope 10 lie in a common plane, the upper end 62 of the tool 31 moves out of the drawing as the tool rotates, whereas the chain 10 moves in the opposite direction, directly into the drawing. Contact at the surface 40, beginning at the line 52 and extending back toward the trailing edge 44, produces a wedging action on the outer surface 50 of the chain that pushes the thin metal shell of the links forward, that is, in the direction of motion of the wedge surface 40 as that surface rotates in the direction indicated by the arrow 58 (FIG. 7).

The wedging surface 40 creates forces on the chain 10 that are normal to the surface 40 and thus have a component parallel to the longitudinal axis 60 of the chain 10 and another component perpendicular to the axis 60. The action of the wedge surface 40 flows and pushes the link outer material without cutting into the surface or removing any material. The shaded area 64 (FIG. 6) indicates the maximum interference between the tool and the chain 10 that is supported in the pulley 22. Such maximum deformation may occur only on one or possibly two links that are adjacent to each other in a single facet. Due to the double helix configuration in the rope chain, gaps appear between the facets.

As illustrated in FIG. 6, the tool 30 operates within a single quadrant of the circular cross-section of the rope chain 10. As best illustrated in FIG. 3*b*, the second tool 31 on the same tool holder 32 will act on an adjacent quadrant of the rope chain 10 and the tools on the tool holder 34 will work on the two quadrants opposite from those worked on by the tools on the tool holder 32. Thus, all four of the quadrants on the rope chain are deformed, without shearing, to provide the cross-section of FIG. 8. Small unworked, round segments 66 remain to separate each faceted quadrant and the essential original roundness is retained in the finished chain 10, albeit flattened somewhat on four sides.

It will be appreciated that hexagonal and octagonal flattening of the outer surface of the rope chain can be accomplished by the addition of more tools and tool holders, with the conical wedging surfaces of the individual tools designed to operate on proportionately smaller portions of the circumference of the chain 10. Flat tools or concave tools with large radii, as viewed along the rope chain's axis 60, are suited to produce hexagonal and octagonal surfaces.

The wedging tools are rotated at a rapid rate, for example, 7,000 revolutions per minute, whereas the chain 10 advances much more slowly, for example, 0 to 35 feet per minute, such that at the point of tangency, substantially all of the relative motion between the tool and the rope chain is attributable to the velocity of the tool. Thus, at one pulley, the outer surface of the chain 10 is worked in small, repetitive increments by two tools alternately with only slight movement of the chain between each wedging impact by the working surfaces 40.

Figure 5:
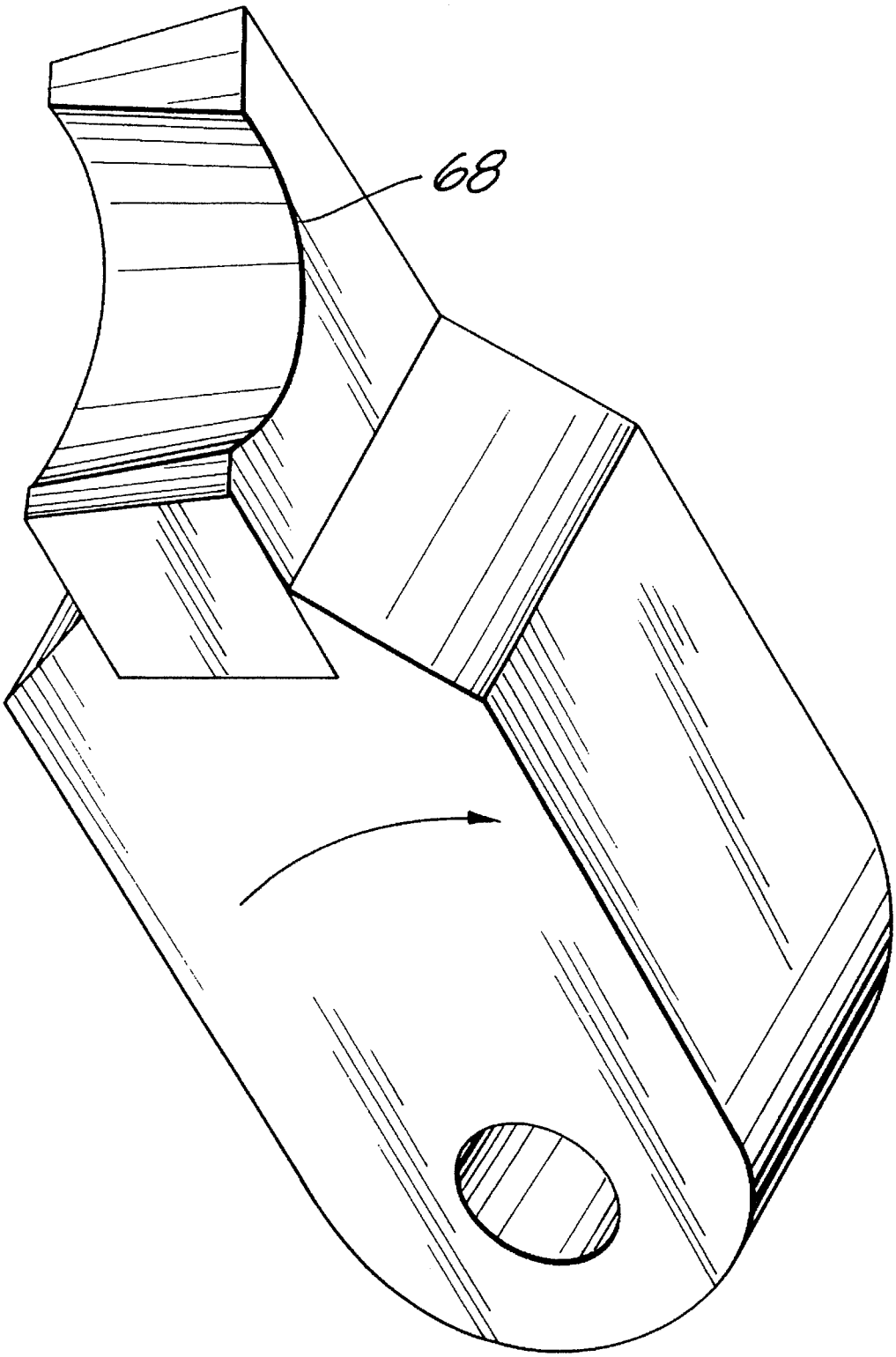
FIG. 5 is a similar to FIG. 4 of a prior art tool used in diamond cutting of solid rope chains by shearing.

Once started, the faceting process proceeds continuously until the entire length of rope chain has been faceted. The faceting process can be effected on a conventional diamond cutting machine, for example, a machine made by the company Ompar of Italy having a model number 2300/2T. A major change which is necessary to convert the conventional diamond cutting machine, which shears metal from the solid rope chain in order to produce facets and thus is not practical to use on hollow chains, is design modification of the shearing tools to provide bevelled surfaces 40 on an otherwise continuous conical surface. FIG. 5 illustrates such a shearing tool. When using this tool to facet solid link chains, the leading edge 68 makes first contact with the outer surface 50 of the rope chain and proceeds to shear away the metal.

As stated, first contact between the bevelled tool of the present invention and the chain 10 is on the conical surface 40, between the leading and trailing edges 42, 44 and not at an edge which might shear the link material. Thereby, a wedging, pushing action is produced in the present invention to replace the shearing action in the conventional diamond cutting machine. Little development is required in converting existing equipment into a faceting apparatus for hollow rope chains, merely by replacing the cutting tools with wedging tools.

It should also be noted that the apparatus of Strobel (U.S. Pat. No. 5,129,220) using a reciprocating tool, unlike the rotating tool of the present invention to pound on the outer surface of the rope chain, tends to locally flatten and indent the link surface. Strobel flattens the links to the extent that the outer surfaces of the links substantially contact the inner surfaces of the links. To the contrary, in the present invention, the inherent original roundness of the rope chain and the individual links are substantially maintained while still providing attractive facets by a gentle bending and deforming of the outer surfaces in the longitudinal direction of the rope chain. The flat or indented facet surface, that results from a tool which acts only reciprocally toward the center of the rope chain can be avoided. Strobel is not capable of producing the bulging, although flattened, surfaces of the present invention.

Also, due to the high peripheral speed of the wedging tool as compared to a rotating drum on a conventional ice diamond cutting lathe, the chain is under less pressure and can be constructed from a thinner material. The result is more pleasing to the eye.

A tool 30, which has operated effectively in producing hollow rope chains with facets, has a wedge angle 54 (FIG. 7) in the range of approximately 3° to 8° and a trailing angle 56 in the range of approximately 6° to 12°. The tool was rotated at 7,000 rpm and the rope chain moved in a range of approximately 0–35 feet per minute.

It will thus be seen that the objects set forth above, among those made apparent from the preceding description, are efficiently attained and, since certain changes may be made in carrying out the above method without departing from the spirit and scope of the invention, it is intended that all matter contained in the above description shall be interpreted as illustrative and not in a limited sense.

What is claimed is:

1. A method of faceting a hollow rope chain having a longitudinal axis and a generally circular envelope, comprising the steps:

(a) supporting said rope chain at a first location against motion transverse to said longitudinal axis;

(b) wedging a first circumferential portion of said rope chain at said first location with a first sloped surface moving relative to said rope chain in a direction substantially parallel to said longitudinal axis at an instant of said impacting, said sloped surface being oriented with an acute angle between said longitudinal axis and said sloped surface, said impacting deforming said first circumferential portion of said rope chain.

2. A method as in claim 1, further comprising the steps:

(c) moving said rope chain longitudinally to pass said first location;

(d) repetitively wedging, as in step (b), said moving chain at said first location, whereby said first circumferential portion is deformed along a length of said rope chain.

3. A method as in claim 2, further comprising the steps:

(e) supporting said rope chain against motion transverse to said axis at a second location;

(f) repetitively wedging a second circumferential portion of said rope chain at said second location with a second sloped surface moving substantially parallel to said longitudinal axis at an instant of said impacting to deform said second circumferential portion.

4. A method as in claim 3, wherein said first sloped surface is generally conical, having an arcuate leading edge and an arcuate trailing edge, the radii of said arcuate edges being greater than a radius of said generally circular envelope of said rope chain.

5. A method as in claim 4, wherein said first sloped surface rotates about an axis generally perpendicular to said longitudinal axis at said first location, a path of said leading edge of said first sloped surface not intersecting said generally circular envelope of said rope chain at said first location, a path of said trailing edge intersecting said generally circular envelope at said first location, whereby said first sloped surface wedges against and deforms said rope chain in a mid-region starting between said leading and trailing edges.

6. A method as in claim 3, wherein said acute angle is in a range of approximately 3° to 8°.

7. A method as in claim 3, wherein said circumferential portions that have been wedged and deformed are separated by an undeformed segment of said generally circular envelope of said rope chain.

8. A method as in claim 3, wherein said rope chain is supported on a pulley at said first location, said first sloped surface moving substantially tangentially to said deformed circumferential portion of said rope chain at said first location, said rope chain and said sloped surface moving in opposite directions at said first location.

9. A method as in claim 4, wherein said generally conical first sloped surface is intersected by a second conical surface having an acute angle relative to said longitudinal axis of said rope chain at said first location, said acute angle being in a range of 6° to 12°.

* * * * *